US005890977A

United States Patent [19]

Taylor

[11] Patent Number: 5,890,977

[45] Date of Patent: Apr. 6, 1999

[54] GOLF PUTTER ALIGNMENT METHOD

[76] Inventor: John R. Taylor, 3350 Western Center Blvd. #274, Fort Worth, Tex. 76137

[21] Appl. No.: 975,013

[22] Filed: Nov. 20, 1997

[51] Int. Cl.[6] ..... A63B 69/36

[52] U.S. Cl. ..... 473/409; 473/238; 473/252; 473/316; 473/293; 273/DIG. 24

[58] Field of Search ..... 473/253, 254, 473/242, 409, 238, 252, 293, 316

[56] References Cited

U.S. PATENT DOCUMENTS 4,569,525 2/1986 Folger ..... 473/242

*Primary Examiner*—George J. Marlo
*Attorney, Agent, or Firm*—Akin, Gump, Strauss, Hauer & Feld, L.L.P.

[57] ABSTRACT

A golf club has a head with a ball contact face and a shaft with surface indicia thereon or on an attachment thereto which may be used to provide for aligning the club face to be in a plane substantially perpendicular to a predetermined ball trajectory. The shaft or attachment may be of rectangular or square cross section with one or two surfaces extending normal to the club face and including contrasting indicia on such surfaces with respect to surfaces which extend parallel to the club face. The shaft may be of circular cross section with contrasting indicia provided on opposite sides of the shaft with respect to a plane through the central axis of the shaft and parallel to the club face, or include a hand grip with a generally flat thumbrest surface with contrasting indicia and extending in a plane perpendicular to the ball contact face. The club face is positioned in a plane perpendicular to a predetermined trajectory of the ball by establishing a line of sight parallel to the trajectory and rotating the club until the indicia on the shaft or handgrip surfaces which extend in a plane perpendicular to the club face is not seen. Alternatively, while addressing the ball in a conventional manner, the shaft is rotated about its central axis until the alignment surfaces extending parallel to the club face are not seen, or are seen to a desired degree.

5 Claims, 6 Drawing Sheets

GOLF PUTTER ALIGNMENT METHOD

FIELD OF THE INVENTION

The present invention pertains to a golf club, having a shaft portion with surfaces which are painted or marked with contrasting indicia to assist in aligning the club face to provide the desired ball trajectory, and a method of aligning a club face using such a golf club to provide the desired ball trajectory.

BACKGROUND

One of the more difficult aspects of the game of golf is the proper aligning of the club face before driving or contacting the ball to provide the desired ball trajectory. Club face alignment to provide the desired ball travel path or trajectory is particularly important when using any golf club, including driver and fairway woods, all irons and when using a putter.

Heretofore, certain golf clubs, such as putters, have been provided with alignment markings, including painted lines or grooves on the top of the club head which are of some assistance in aligning the club face with the desired ball trajectory. However, the location of the club head during the alignment process does not lend itself to permit the golfer to be in a position to properly place the club in a position which allows the club face to be perpendicular to the desired trajectory or travel path of the ball. One desired position for aligning the club is when the golfer can sight from a point behind the club and the ball toward the green, cup pin or the cup itself. However, conventional club marking means do not provide for accurate aligning of the club face prior to stroking of the club if the golfer must move his head to a position where a proper sighting can be made based on the position of the ball and the green or the cup.

Moreover, when a golfer is standing in the normal position of addressing the ball prior to stroking the club, prior art alignment devices do not provide sufficient accuracy for proper alignment of the club face with respect to the ball and a desired trajectory or travel path of the ball. Still further, rules governing competitive golf events eliminate any extraneous or "add-on" devices, such as pointers, alignment bars or similar mechanisms for aiding the golfer in aligning the club face with respect to the desired ball travel path.

However, the present invention overcomes the deficiencies of prior art alignment devices and methods and provides a golf club having a shaft or a shaft attachment which is of an advantageous configuration and is provided with suitable indicia, such as contrasting painted, coated or reflective surfaces of contrasting colors or visual perceptability thereon which provide a surprisingly improved alignment means for properly aligning the club face to provide a desired ball trajectory. Still further, the invention overcomes deficiencies in prior art golf alignment devices and methods by providing an improved method for placing the club face in a desired position with respect to the ball prior to contact therewith.

SUMMARY OF THE INVENTION

The present invention provides an improved golf club and method for using same wherein accurate alignment of the club face with respect to the ball and the desired trajectory or travel path of the ball may be provided.

In accordance with one important aspect of the present invention a golf club is provided with a club shaft which is configured in such a way that suitable indicia or contrasting markings on the shaft provides for positioning the club face in a desired alignment with respect to a golf ball based on a predetermined, desired trajectory or travel path of the ball. The club shaft may be provided in different polygonal cross sectional configurations, for example square, rectangular or cross shaped or the shaft may be oval or circular with suitable indicia place thereon to provide the alignment feature and to permit carrying out the method of the invention. Still further, the invention provides an attachment device for attachment to a conventional golf club shaft which is configured in such a way and provided with suitable indicia or contrasting color marking on the surfaces thereof to provide the alignment feature.

The invention contemplates a golf club with a shaft or shaft attachment or a grip portion of the shaft configured in such a way that surfaces are provided thereon which are disposed in a plane or planes substantially perpendicular to the club face or parallel to the expected or desired ball trajectory on leaving the club face after contact therewith and suitable indicia on these surfaces are used by a person holding the club to make a visual sighting which allows the person using the club to align the club face with the ball and the desired ball trajectory.

The method of the invention contemplates the use of a golf club of a type as described above wherein the club may be placed adjacent to and behind the ball with respect to the ball travel path toward the green or the cup and by visual sighting along a line between the ball and the green or cup, or a desired point to one side or the other of the cup, such that the club head may then be pivoted or rotated until a certain indicia or visually contrasting surface on the shaft or an attachment thereto is seen to a certain degree or not seen indicating that the club face is disposed at a desired angle with respect to the ball or is substantially perpendicular to the desired trajectory of the ball. In this way a more accurate alignment of the club face with respect to the desired travel path of the ball may be obtained than heretofore provided with conventional golf clubs and alignment devices or markings.

Those skilled in the art will further appreciate the above noted advantages and features of the invention together with other important aspects thereof upon reading the detailed description which follows in conjunction with the drawing.

DESCRIPTION OF THE PREFERRED EMBODIMENTS

Figure 1:
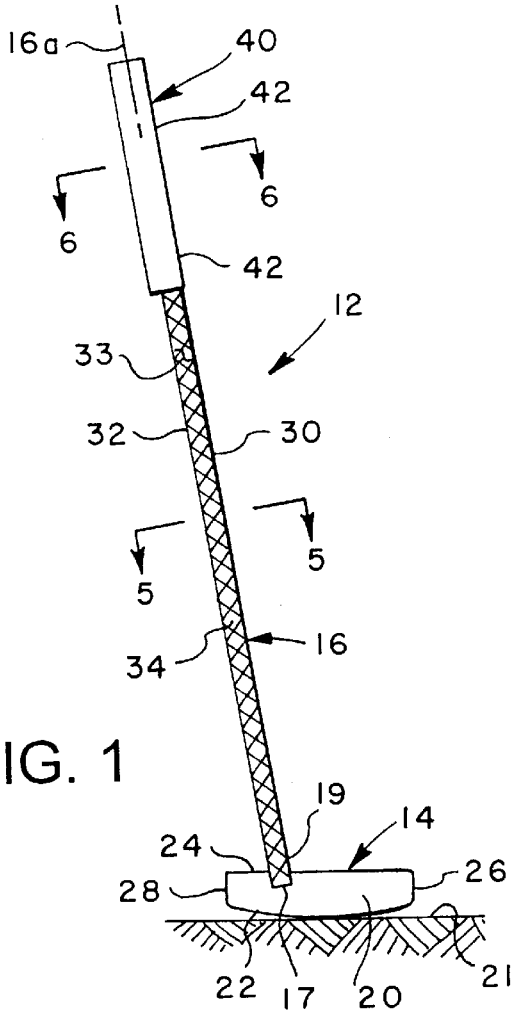
FIG. 1 is a side elevation of one preferred embodiment of a golf club in accordance with the invention.

In the description which follows, like parts are marked throughout the specification and drawing with the same reference numerals, respectively. The drawing figures are not necessarily to scale and certain features may be shown in exaggerated or generalized form in the interest of clarity and conciseness.

Figure 2:
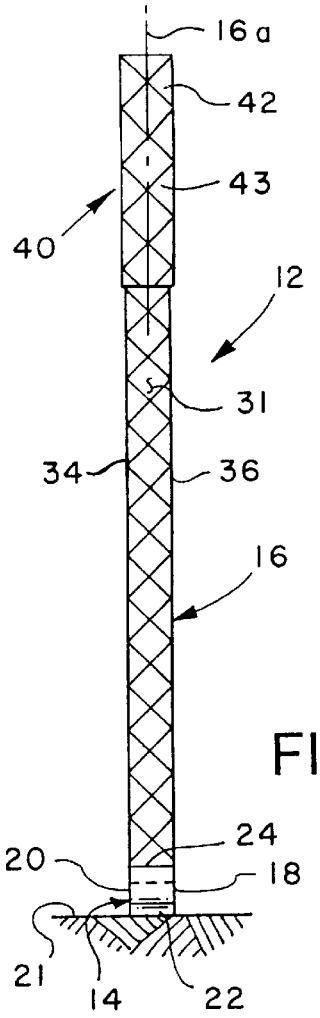
FIG. 2 is an end elevation of the golf club shown in FIG. 1.

Referring to FIGS. 1 and 2, in particular, there is illustrated an improved golf club in accordance with the present invention and generally designated by the numeral 12. The golf club 12 is illustrated as a putter, although the invention may be utilized with essentially all other golf clubs, such as irons or woods. The putter 12 includes a head 14 and a shaft 16, the head including opposed, parallel ball contact faces 18 and 20. Only one face 18 or 20 may be operable, depending on whether the club is of a uni-directional or bi-directional design. The ball contact faces 18 and 20 are parallel to each other and lie in planes which are perpendicular to a bottom face 22 having at least a slightly convex curvature. The planes of the surfaces 18 and 20 are also preferably perpendicular to a top face 24. The putter head 14 also has a toe portion 26 and a heel 28.

Figure 5:
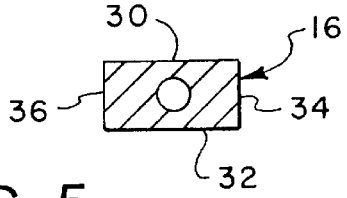
FIG. 5 is a section view taken from the line 5—5 of FIG. 1.

The shaft 16, in the embodiment of FIGS. 1 and 2, includes a longitudinal central axis 16*a* and is characterized as a generally rectangular cross section member, see FIG. 5 also. The shaft 16 is suitably secured to the head 14 by insertion of a lower distal end 17 of the shaft in a slot 19 in the head 14, which slot is adapted to intersect the planes of the faces 18 and 20 at an angle of about 90°. However, the shaft 16 also extends upward from the top face 24 at a conventional angle of about 10° from the vertical when the head 14 is placed in a normal operative position on a putting surface 21. The rectangular cross sectional configuration of shaft 16 provides generally planar front and back surfaces 30 and 32 and opposed end surfaces 34 and 36. The surfaces 30 and 32 are planar, parallel to each other and perpendicular to the parallel and planar surfaces 34 and 36. The surfaces 30 and 32 also lie in planes which are perpendicular to the faces 18 and 20. Preferably, the surface 30 is provided with suitable indicia 31 thereon which visually contrasts markedly with indicia 33 on the surfaces 34 and 36. Surface 32 is also preferably provided with indicia of the same contrasting color as the indicia 31 or at least contrasting with the indicia 33 on surfaces 34 and 36. For example, the surfaces 30 and 32 may be painted with a fluorescent or highly luminous coating in a color which is highly visible while the surfaces 34 and 36 are painted in another color 33, preferably flat black, for example, or any color or indicia wherein the visual perception thereof contrasts markedly with the color or visual perception of the indicia 31. The indicia 31 may be a highly reflective mirrorlike coating also.

Figure 6:
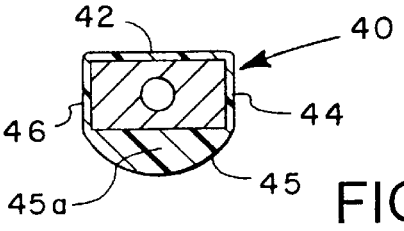
FIG. 6 is a section view taken from the line 6—6 of FIG. 1.

The golf club 12 is also provided with a hand grip 40 connected to or formed integral with the upper distal end of the shaft 16. The handgrip 40 preferably includes a flat, generally planar grip or thumbrest surface 42 which is parallel to the surfaces 30 and 32 and may also be provided with suitable indicia 43 on the surface thereof of a contrasting color or visual perception with respect to the remainder of the grip and the surfaces 34 and 36. The other surfaces of the grip 42 may be of different geometries and may be flat or curved, for example, and are preferably all of the same or contrasting colors and are indicated in FIG. 6 as surfaces 44, 45 and 46, by way of example. The surface 42 may be of the same color or indicia as the surface 30 and the surface 42 is substantially parallel to the surface 30, or at least disposed in a plane substantially perpendicular to the club faces 18 and/or 20. The grip 40 may be formed of a suitable flexible polymer material, for example, and forcibly pulled over the distal end of the shaft 16, molded integral with the shaft 16 or formed of built up materials, such as a cushion part 45*a*, FIG. 6, which is wrapped with tape, or an outer skin defining the surfaces 42, 44, 45 and 46. The grip 40 may be formed in other ways but an important feature is the surface 42 which is disposed in a plane perpendicular to the faces 18 and 20, is substantially planar and is provided with suitable indicia or color coating 43 which is contrasted with the other surfaces of the grip 40. In fact, the alignment feature of the club 16, if desired, may reside only in the contrasting color of the indicia 43 with respect to the remaining surfaces of the grip 40.

Figure 3:
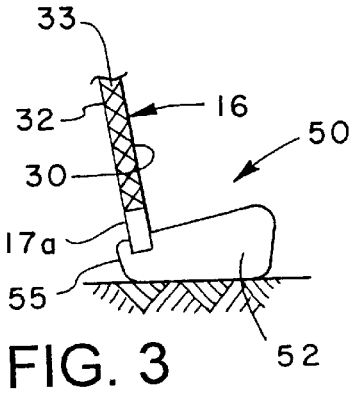
FIG. 3 is a side elevation of a first alternate embodiment of a golf club in accordance with the invention.
Figure 4:
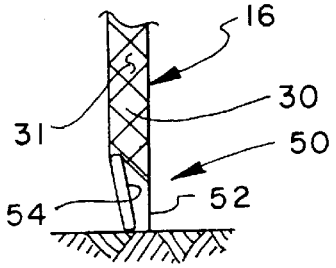
FIG. 4 is an end elevation of the golf club shown in FIG. 3.

Referring now to FIGS. 3 and 4, although the shaft 16 is particularly useful for inclusion in a golf club 12 comprising a putter, the unique aspects of the present invention are not confined to putter type golf clubs only. In FIGS. 3 and 4 there is illustrated a golf club comprising, for example, a midiron 50 having a suitable head portion 52 with a ball engaging face 54 and a heel portion 55, FIG. 3, to which the lower distal end of the shaft 16 is connected. In the golf club 50, the shaft 16 is slightly modified at a lower distal end 17*a* to accommodate the configuration of the midiron head 52. Accordingly, the shaft 16, when used with the club 50, for example, also provides the advantage of the contrasting indicia 31 on the surfaces 30 and 32, for example, with respect to the indicia or coloring 33 of the surfaces 34 and 36 to provide the alignment feature which is useful with the method of the invention described hereinbelow.

Figure 7:
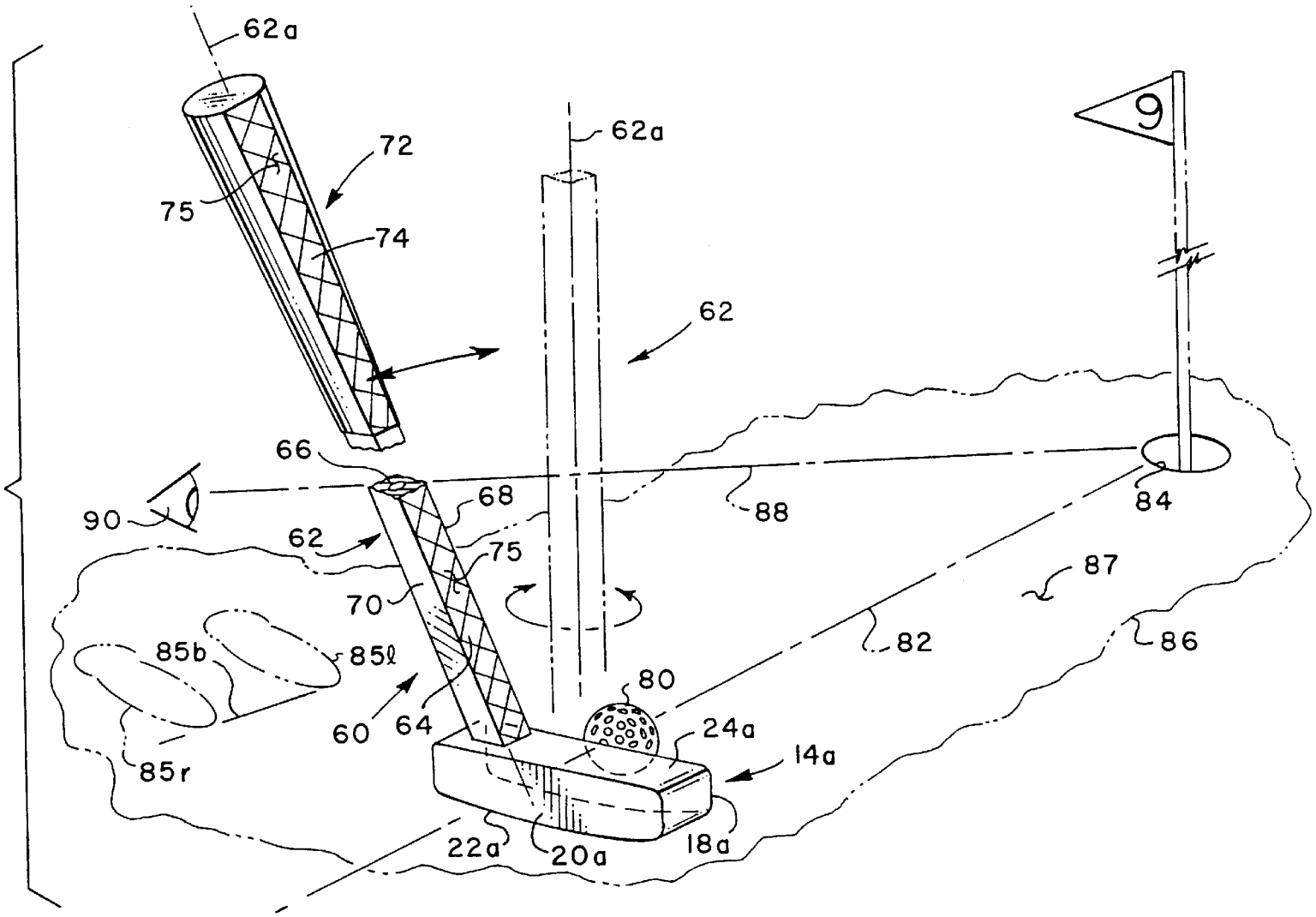
FIG. 7 is a perspective view of a second alternate embodiment of a golf club in accordance with the invention and also illustrating the alignment method of the invention.

Referring now to FIG. 7, another embodiment of a golf club in accordance with the invention is illustrated and generally designated by the numeral 60. The club 60 also comprises a putter having a head 14*a* substantially like the head 14 but modified to be connected to an elongated shaft 62 having a central axis 62*a* and a polygonal cross sectional shape, which is preferably square, to provide opposed surfaces 64 and 66 which are parallel to each other and extend in planes normal to the ball contact faces 18*a* and 20*a*. Surfaces 64 and 66 are also normal to opposed parallel surfaces 68 and 70. A grip 72 is attached to the upper distal end of the shaft 62, is configured similar to the grip 40 of the club of FIG. 1, and includes a thumbrest surface 74 lying in a plane substantially parallel to the plane of the surface 64. Surfaces 64, 66 and 74 may be provided with suitable indicia or a color coating 75 which contrasts visually with the color of the remainder of the shaft 62 and the grip 72. For example, the color coating 75 may be a highly visible luminescent color and the surfaces 68 and 70 and the remaining surfaces of the grip be of a markedly contrasting color, such as flat black. Accordingly, the club 60 may be used in substantially the same manner as the club 12 FIG. 1, and the club 50 of FIGS. 3 and 4, and in accordance with the method of the present invention.

One preferred method in accordance with the invention is illustrated generally in FIG. 7. When using the club 60, for example, to cause a golf ball 80 to follow a predetermined trajectory or travel path 82 toward a cup 84 on a golf green 86 along a surface 87, it is important to align the club face 18*a* (corresponding to face 18 of the embodiments of FIGS. 1 and 2, or face 20 if the golfer is left handed) perpendicular to the trajectory 82. Since the surfaces 64, 74 are perpendicular to the club face 18*a*, if these surfaces are aligned with or are moved to a position substantially co-planar with the trajectory 82 then the face 18*a* or 20*a* will be in proper alignment for striking the ball and causing the ball to follow the trajectory 82.

A person using the club 60 will preferably place the club head 14*a* behind the ball 80 and rotate the shaft 62 until it is perpendicular to surface 87. Such person will then sight along a sight line 88 with the person's eye 90 and, preferably move the club 60 laterally, if necessary, so that the shaft 62 is in a plane which includes lines 82 and 88. The club head 14*a* and shaft 62 are then rotated about the longitudinal central axis 62*a* while the head is resting on surface 87 until the surfaces 64 and 66 and/or 74 are not visible. Accordingly, once the sight line 88 is established to be co-planar with the trajectory 82 and the club 60 is rotated as described in such a way that the indicia 75 on the surfaces 64 or 66 or 74 cannot be seen, or seen to a desired degree, then it is considered that the club face 18*a* is substantially perpendicular to the trajectory 82, or in the desired position to provide a desired trajectory, respectively.

Of course, the person using the club 60 may not have to stand behind the club but may stand in a substantially conventional position for addressing the ball 80 prior to stroking the club 60 and then bend down and turn one's head in such a way that the sight line 88 can be established. The club 60 can then be rotated on its surface 22*a* until the shaft 62 is substantially perpendicular to surface 87 and then rotated about the central axis 62*a* of the shaft until the surfaces 64 and/or 66 or 74 are not visible, thereby establishing a position of the face 18*a* which is substantially perpendicular to the trajectory 82. Of course, the club 60 is then rocked back on its surface 22*a* carefully to the conventional position for addressing and striking the ball 80, without rotating the club to take the face 18*a* out of a plane normal to the trajectory 82.

Alternatively, a method in accordance with the invention contemplates that only the surface 74 of the grip 72 may be used as the alignment surface and once this surface is not visible or is visible to a desired degree, using the same method as described above, the golfer knows that proper alignment of the face 18*a* or 20*a* is achieved Moreover, the method of the invention contemplates that the golfer may, while addressing the ball 80 in a conventional stance, facing a direction substantially perpendicular to the trajectory 82 and holding the club in a position approximately ready to strike the ball 80, view the shaft 62 while looking downward thereon. For example, as shown in FIG. 7, a golfer, addressing the ball 80 in a conventional manner while holding the club 60 would place his/her feet 851 and 85*r* along a line 85*b* substantially parallel to the trajectory 82, thereby causing the golfer to face substantially normal to the trajectory 82. While holding the club 60 in a conventional manner prior to striking the ball 80, the golfer may look downward on the shaft 62 and the handgrip 72. The shaft 62 is then rotated until the surfaces 68 and 70 are not visible and only the surface 64 is visible, or the surfaces 68 or 70 are visible to a desired degree, thereby indicating that the club face 18*a* is perpendicular to the trajectory 82. Of course, the trajectory 82 is not required to be a path directly toward the cup 84 but may, for example, be designated to compensate for various playing conditions, including the slope of the surface 87.

The method described herein may, of course, be utilized when placing shots with clubs other than the putter 60. For example, the mid iron 50 may be aligned, when addressing a ball, in the same manner described above for the club 60. In like manner other clubs normally used for long, intermediate or short shots may also be aligned for improving accuracy of the ball trajectory or travel path utilizing the method of the invention and incorporating a shaft having the features of the invention set forth herein.

Figure 8:
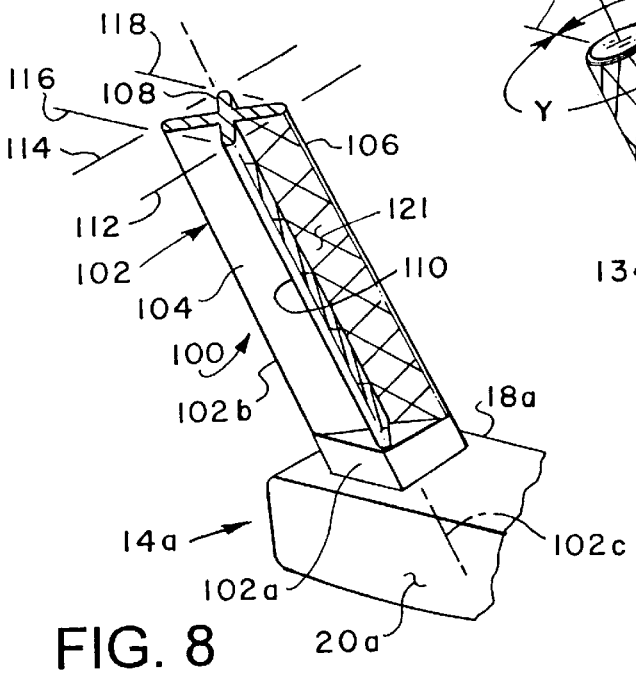
FIG. 8 is a detail perspective view of a third alternate embodiment of a golf club in accordance with the invention.

Referring now to FIG. 8, a third alternate embodiment of a golf club in accordance with the invention is illustrated and generally designated by the numeral 100. The club 100 may also be a putter having a head 14*a* and a shaft 102 having a lower distal end part 102*a* of square cross section and an elongated shank part 102*b* (only a portion of which is shown in FIG. 8) which has a cross section of a generally "X" or cross shape, as indicated. In other words, the cross section of the shaft 102 has two opposed, projecting portions 104 and 106 which are coplanar and are normal to coplanar opposed projecting portions 108 and 110 forming the cross or "X" shape. The distal edges of the projecting portions 106 and 110 lie in a plane which includes the line 112 and is perpendicular to the face 18*a* and the face 20*a*, for example. The distal edges of projecting portions 104 and 108 lie in a plane which includes the line 114 parallel to the line 112 and also perpendicular to the faces 18*a* and 20*a*. In like manner the distal edges of the projections or projecting portions 104 and 110 lie in a plane which includes a line 116 and the distal edges of the projections 106 and 108 lie in a plane which includes a line 118 parallel to the line 116 and perpendicular to the lines 112 and 114.

The surfaces of the projections 106 and 110 extending between the distal edges of these projections, respectively, may be coated with a suitable indicia 121 of a color or visual perceptability which contrasts with the color or visual perceptability of the surfaces of the projections 104 and 110 which extend between the distal edges of these projections, respectively. The surfaces of the projections 104 and 108 extending between the distal edges of these projections, respectively, may be of the same color or show the same indicia as the indicia 121. Accordingly, the surfaces between the distal edges of the projections 106 and 108 may also be provided with a contrasting indicia similar to that which is formed on the surfaces of the projections 104 and 110 between the distal edges thereof, respectively. The effect of this type of contrasting indicia on the cross shaped shaft 102 is essentially the same as that provided by the shafts 16 and 62 of FIGS. 1 and 7, for example. In other words, when the club 100 is rotated about a central axis 102*c* of the shaft 102, the indicia 121 will not be visible or only partially visible when the club face 18*a* is perpendicular to the desired ball trajectory or travel path utilizing the method described hereinabove.

Figure 9:
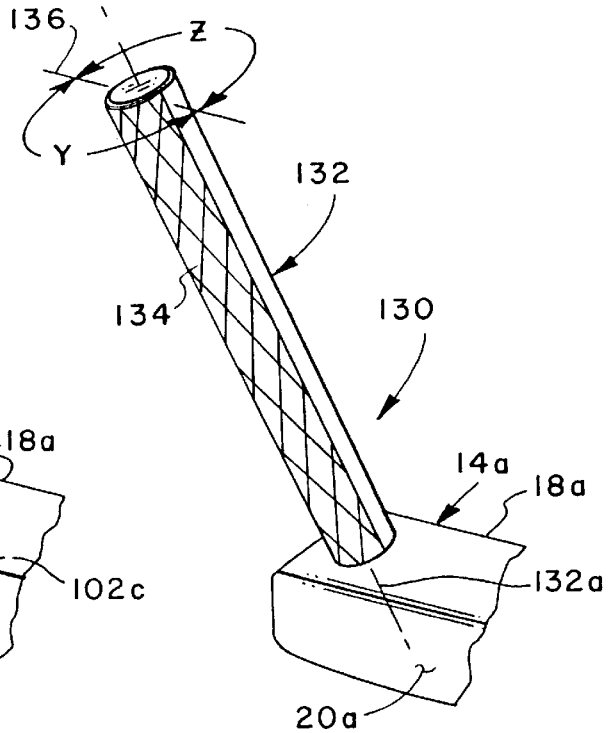
FIG. 9 is a perspective view of a fourth alternate embodiment of a golf club in accordance with the invention.

Referring to FIG. 9, a fourth alternate embodiment of a golf club in accordance with the invention is illustrated and generally designated by the numeral 130. The club 130, for the sake of discussion herein, utilizes a head 14*a* and a shaft 132 suitably attached to the head 14*a* which may require modification to provide a cylindrical receptacle for the lower distal end of the shaft 132, as compared with the square cross section lower distal ends of the shafts 62 and 102. Cylindrical shaft 132 is provided with suitable indicia 134 extending over an arc of about 180° with respect to central longitudinal axis 132*a*, as indicated by arc Y in FIG. 9, which arc extends across the shaft 132 from a line 136 which lies in a plane parallel to the faces 18*a* and 20*a* of the head 14*a*. The surface of the shaft 132 over the arc Z, as indicated in FIG. 9, with respect to axis 132*a* is of a contrasting color with respect to the indicia 134 so that, when the club 130 is utilized in accordance with the method of the invention, if only the indicia 134 is visible, it is indicated that the club face is aligned with the desired trajectory of the ball.

Figure 10:
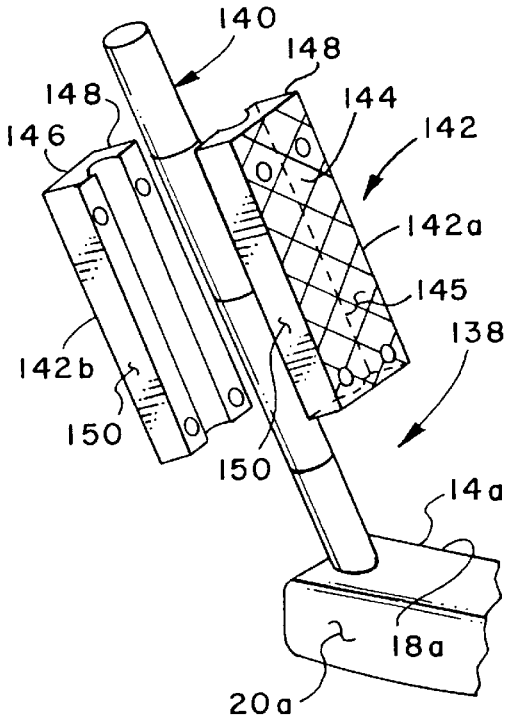
FIG. 10 is a perspective view of a club alignment attachment device in accordance with a fifth alternate embodiment of the invention.

Still another embodiment of the invention is illustrated in FIG. 10. In FIG. 10 a golf club 138 is illustrated including a head 14*a* connected to a conventional elongated tubular shaft 140. The shaft 140 is operable to have mounted thereon an alignment device, generally designated by the numeral 142, including opposed members 142*a* and 142*b* which may be identical and, when clamped on the shaft 140, form a rectangular alignment device having opposed alignment surfaces 144 and 146, as well as opposed alignment surfaces 148 and 150, forming an alignment means similar to the rectangular shaft 16. Suitable indicia 145 may be applied to surface 144 and contrasting with the color or indicia on the surfaces 150 and 148. The alignment device 142 may be attached to the shaft 140 using conventional fastening means, such as threaded fasteners not shown, or suitable interlocking tabs and receptacles formed on the respective parts 142*a* and 142*b*. As long as the device 142 is clamped tightly on the shaft 140 and with the surfaces 144 and 146 extending in planes normal to the faces 18*a* and 20*a*, the device 142 may be used on a conventional golf club to carry out the method of the invention. The alignment device 142 may be of other cross sectional configurations, including square, other polygonal shapes or have the cross shape of the embodiment of FIG. 8, for example.

Figure 11:
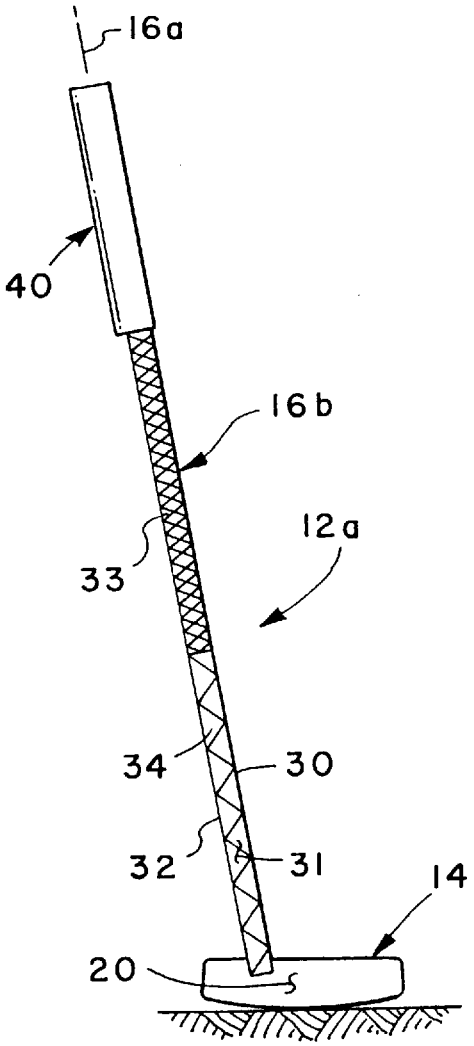
FIGS. 11 and 12 are side and end elevations, respectively, of a sixth alternate embodiment of the invention.
Figure 12:
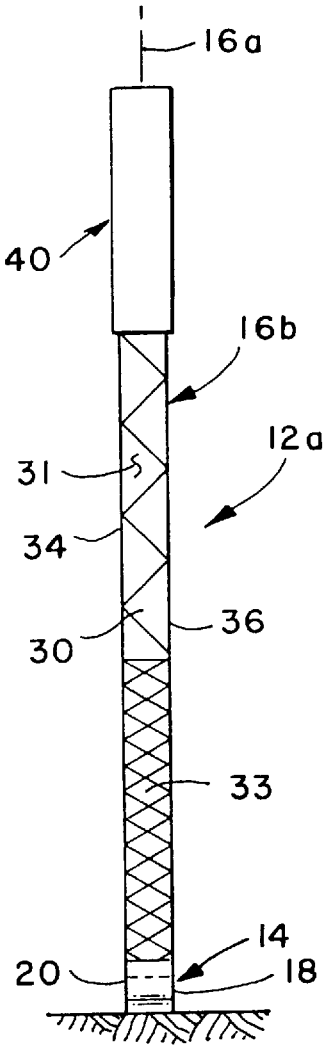

Referring now to FIGS. 11 and 12, there is illustrated a sixth alternate embodiment of the invention comprising a golf club 12*a* substantially like the club 12 and including a rectangular shaft 16*b* connected to a club head 14. The golf club 12*a* is substantially like the golf club 12 except for the arrangement of indicia on shaft surfaces 30, 32, 34 and 36. In the embodiment illustrated in FIGS. 11 and 12, approximately the lower half of the shaft 16*b* is provided with contrasting indicia on the surfaces 30, 32, 34 and 36 wherein highly visible indicia 31 is provided on the surfaces 34 and 36 and less visible indicia, such as a flat black coating or the like 33, is provided on the surface 30, in particular.

However, on the upper half of the shaft 16*b*, between the head 14 and the hand grip 40, the arrangement of the indicia 31 and 33 is reversed or, in other words, is like that for the shaft 16 of the golf club 12 shown in FIGS. 1 and 2. Accordingly, the golf club 12*a* may be used to align the faces 18 and/or 20 with the desired ball trajectory in accordance with the method of the invention wherein, for example, if the person using the club 12*a* wishes to align the club face 18 by establishing a line of sight and viewing the shaft 16 from a position of the person's viewing eye 90 as indicated in FIG. 7, the person would view the upper half of the shaft 16*b* and rotate the shaft about longitudinal axis 16*a* until the indicia 31 on the surfaces 30 and/or 32 was not visible, or visible to the desired degree.

Alternatively, if a person using the golf club 12*a* was standing in a conventional position holding the club and addressing a ball for executing a stroke of the club 12*a*, then such person would align the club face 18 or 20 by viewing the lower half of the shaft 16*b* and rotating the shaft about its axis 16*a* until the highly contrasting indicia 31 on the surfaces 34 and 36 was not visible or visible to the desired degree. This would indicate that the club face 18 was substantially perpendicular to the anticipated ball trajectory established by the person using the club.

Figure 13:
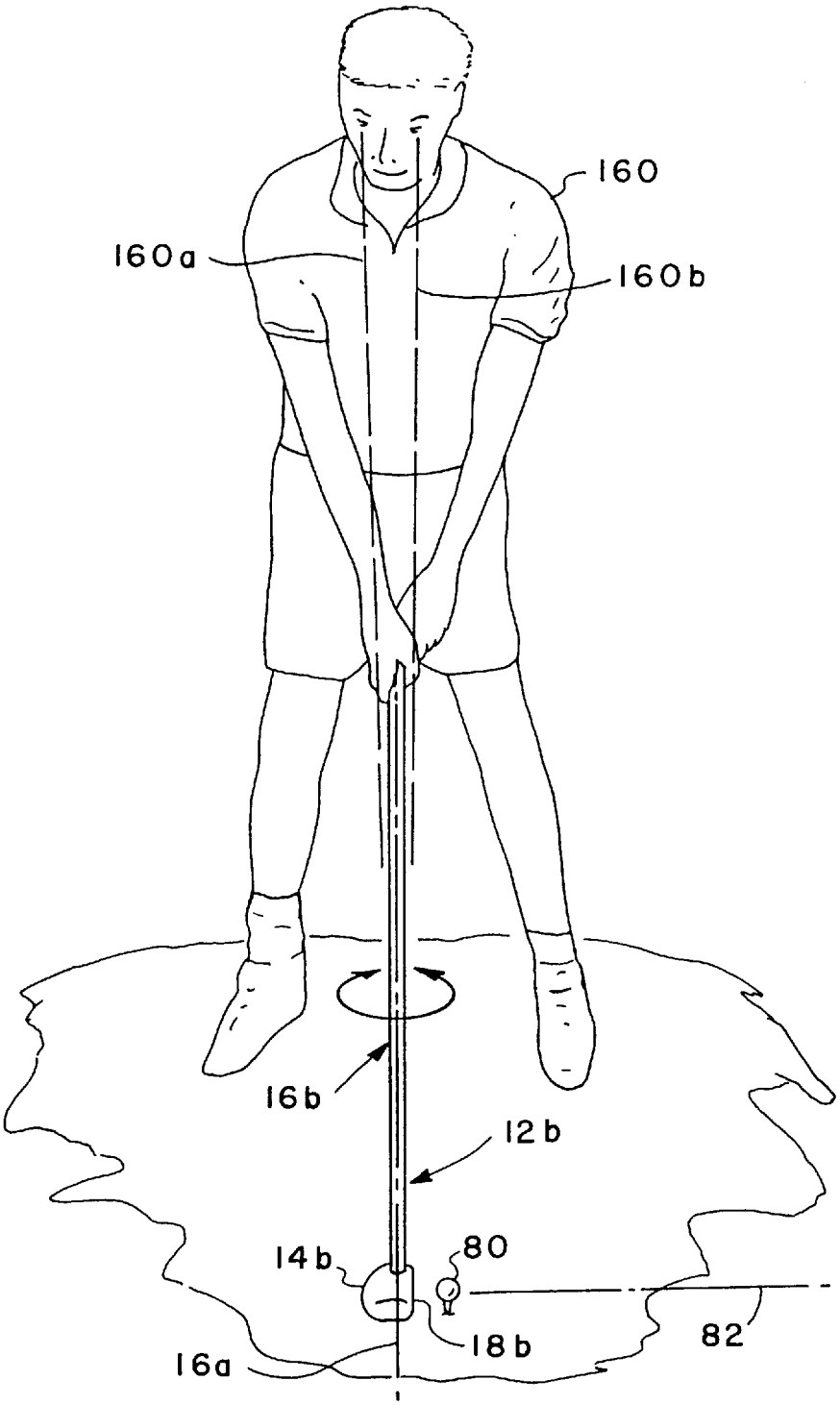
FIG. 13 is a side elevation of a golfer addressing a ball with a club comprising a seventh alternate embodiment of the invention.

The method just described with regard to the embodiment of FIGS. 11 and 12 is also illustrated for a seventh alternate embodiment of a golf club in accordance with the invention, shown in FIG. 13 and generally designated by the numeral 12*b*. The golf club 12*b* includes the shaft 16*b* which is connected at its lower distal end to a club head comprising a driver wood 14*b*. The club head 14*b* includes a ball contact face or surface 18*b* for contacting ball 80 to drive same along a desired trajectory 82. Accordingly, a golfer 160, addressing the ball 80 as a right handed golfer would stand in the position shown, addressing the ball 80 with the club 12*b* and viewing the shaft 16*b* generally along sight lines 160*a* and 160*b*. The golfer 160 would then rotate the shaft 16*b* about its central axis 16*a* until the indicia 31 on the lower part of the shaft 16*b* was not visible or, visible to a desired degree, prior to driving the ball so that the club face 18*b* would be perpendicular to the trajectory 82 or in a preferred position with respect to the desired trajectory 82.

Figure 14:
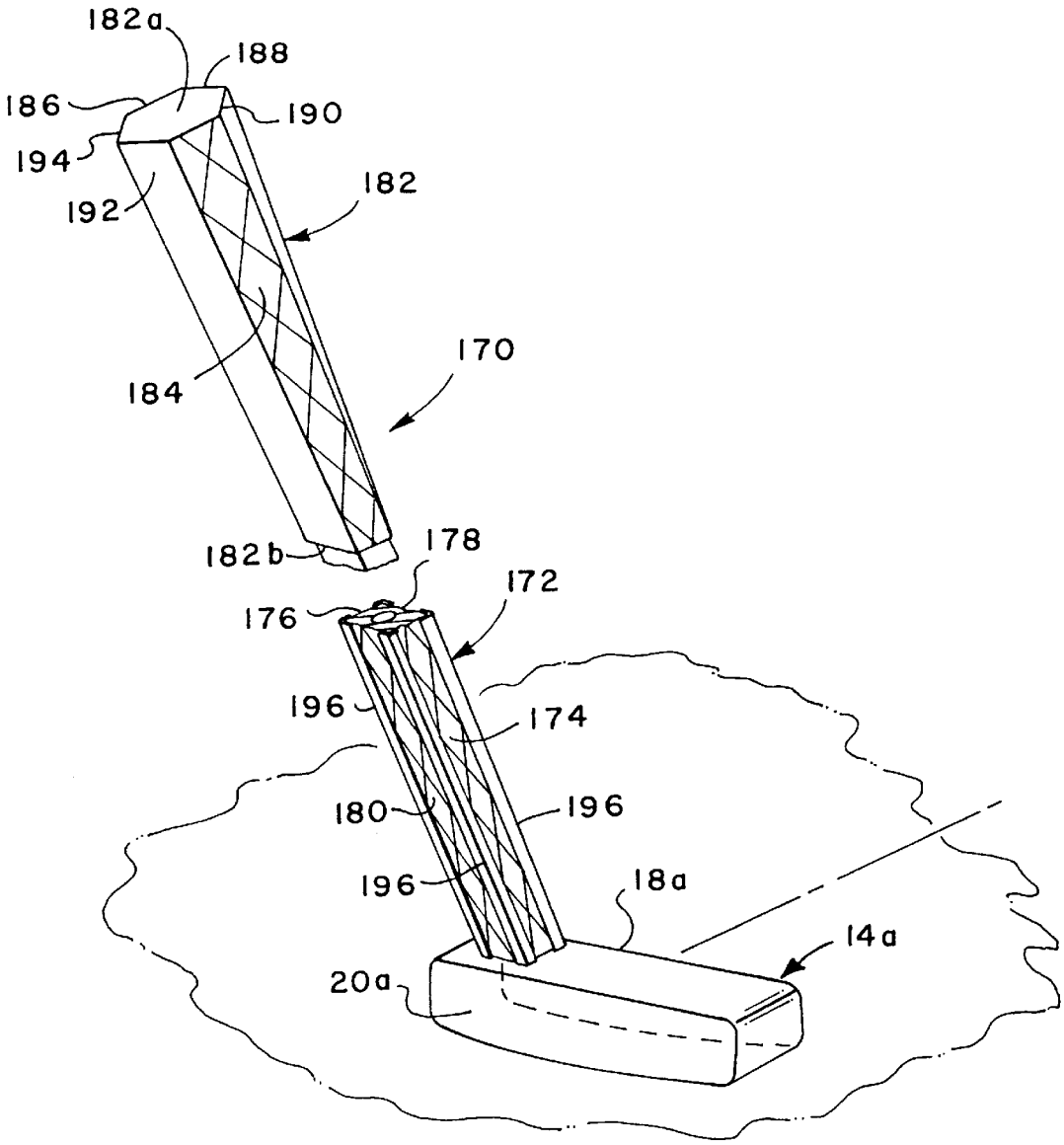
FIG. 14 is a perspective view of an eighth alternate embodiment of a golf club in accordance with the invention.

Referring now to FIG. 14, still another embodiment of the invention is illustrated in the form of a golf club 170 having a club head 14*a* with a ball contact face 18*a* and opposing ball contact face 20*a*, if desired. The golf club 170 includes a square cross section shaft 172, similar to the shaft 62 of the embodiment of FIG. 7 having surfaces 174 and 176 extending parallel to each other and substantially perpendicular to the head faces 18*a* and 20*a*. Surfaces 178 and 180 are parallel to each other and perpendicular to the surfaces 174 and 176. The square cross section shaft 172 is attached to the head 14*a* in the same manner as described above for the embodiments previously described.

The golf club 170 also includes a modified grip portion 182 which is of a polygonal cross section shape including a surface 184 substantially parallel to the surface 174 and perpendicular to the club face 18*a*. An opposing surface 186 is formed on the grip portion 182 and is parallel to the surface 184. As shown, by way of example, the grip portion 182 has a hexagonal cross sectional shape with surfaces 188, 190, 192 and 194 interposed between the surfaces 184 and 186. The widths of the surfaces forming the grip 182 may decrease from the upper distal end 182*a* of the grip portion to the opposite is end 182*b* to facilitate ease of handling of the golf club 170.

In accordance with the invention, it is contemplated that the shaft 172 may have indicia of the same color or visual perceptibility on all of the surfaces 174, 176, 178 and 180 and, depending on the particular color of the surfaces, no contrasting indicia may be required. However, as described above, contrasting indicia substantially assist in utilizing the golf clubs in accordance with this invention when practicing the method of alignment in accordance with the invention. Still further, it has been determined that if, in particular, the indicia on the surfaces 174, 176, 178 and 180 are all of the same color, or if the surfaces 174 and 176 have indicia which contrasts with the colors on the surfaces 178 and 180, proper alignment of the club may be enhanced by providing a relatively thin vertical stripe or line 196 extending parallel to the intersections of the surfaces of the shaft 172 with each other. In particular, if a thin contrasting stripe or line 196 is provided on the shaft 172 at the intersection of the surface 174 with the surfaces 178 and 180 that improved visual perceptibility of the position of the shaft may be obtained. Of course, the stripe or line 196 may be provided at the intersections of all of the surfaces of a square cross section or other polygonal cross section shaft or at the so-called corners of the shaft, if desired. The golf club 170 may, as with the other embodiments herein described, be a putter, or any of the clubs normally used in executing the game of golf.

Those skilled in the art will recognize from the foregoing description that unique golf club alignment devices and methods have been developed in accordance with the invention which may improve the accuracy and score of a golf game for inexperienced as well as experienced and professional golfers. The elements described in this application may be manufactured using conventional materials for golf clubs and the like including but not limited to steel, aluminum and reinforced polymer materials for the shafts described above and conventional materials for the club heads. Various attachments means may be used for connecting the shafts to the club heads including force fit, mechanical fasteners or suitable adhesives.

Although preferred embodiments of the invention have been described in detail herein those skilled in the art will also recognize that various substitutions and modifications may be made without departing from the scope and spirit of the invention as recited in the appended claims.

What is claimed is:

1. A method for alignment of a golf putter with a golf ball for striking said ball to travel along a predetermined trajectory wherein said alignment comprises placing a ball contact face of said putter to be disposed substantially perpendicular to a predetermined trajectory of said ball, comprising the steps of:

providing a golf putter having a head including a face defining a ball contact surface and an elongated shaft extending from and connected to said head, said shaft including a first surface thereon extending in a plane substantially perpendicular to said face and a second surface thereon extending at an angle with respect to said first surface, said surfaces including contrasting indicia thereon and extending along said shaft between opposite ends of said shaft;

placing said putter adjacent a golf ball lying on a surface;

determining a desired trajectory of said ball upon being struck by said putter;

holding said putter while standing in a first position such that a line of sight may be established which includes said trajectory and while viewing said shaft;

rotating said shaft and said head such that said indicia on said first surface is seen to a predetermined degree thereby indicating that said first surface is disposed in said plane parallel to said line of sight;

moving to a second position facing substantially perpendicular to said trajectory while holding said putter; and viewing said shaft while rotating said shaft about a central axis thereof as required until said first surface is disposed in a plane substantially parallel to said trajectory, thereby placing said face in a plane extending substantially perpendicular to said trajectory prior to swinging said putter to strike said ball.

2. The method set forth in claim 1 including the step of:

providing said club with a shaft having a rectangular cross section with two surfaces of said shaft extending perpendicular to said face and two surfaces of said shaft extending parallel to said face, at least one of said surfaces extending parallel to said face being of a contrasting visual perceptability with respect to at least one of said surfaces extending perpendicular to said face.

3. The method set forth in claim 1 including the step of:

providing said club with a shaft having a square cross section with two surfaces of said shaft extending perpendicular to said face and two surfaces of said shaft extending parallel to said face and indicia on said shaft comprising an elongated, relatively thin line or stripe extending along and parallel to the intersection of at least one of said surfaces extending perpendicular to said face with at least one of said surfaces extending parallel to said face.

4. The method set forth in claim 1 including the step of:

providing said shaft with an attachment device including said first and second surfaces on said attachment device, and mounting said attachment device on said shaft so that said first surface extends in a plane substantially normal to said face.

5. The method set forth in claim 1 wherein:

the step of providing said putter comprises providing a putter with a shaft including a first portion extending upward from said head and including first indicia on said first surface and second indicia on said second surface and a second portion of said shaft extending between said first portion of said shaft and said hand grip and including said second indicia on said first surface and said first indicia on said second surface, and said method includes the step of viewing one of said portions of said shaft while in said first position until indicia on said one portion is seen to a predetermined degree and viewing the other portion of said shaft while facing substantially perpendicular to said trajectory while rotating said shaft to place said face in a plane extending substantially perpendicular to said trajectory.

* * * * *